US006431312B1

(12) United States Patent
D'Antonio

(10) Patent No.: US 6,431,312 B1
(45) Date of Patent: Aug. 13, 2002

(54) MOTORIZED AND COMPUTER OPERATED VARIABLE ACOUSTICS TREATMENT

(75) Inventor: Peter D'Antonio, Upper Marlboro, MD (US)

(73) Assignee: RPG Diffusor Systems, Inc.

( * ) Notice: Subject to any disclaimer, the term of this patent is extended or adjusted under 35 U.S.C. 154(b) by 113 days.

(21) Appl. No.: 09/639,277

(22) Filed: Aug. 15, 2000

(51) Int. Cl.[7] ..... E04B 1/82
(52) U.S. Cl. ..... 181/295; 181/30
(58) Field of Search ..... 181/30, 295, 286; 52/144, 145, 786.12, 787.11, 787.12

(56) References Cited

U.S. PATENT DOCUMENTS

| | | | | | |
|---|---|---|---|---|---|
| 4,298,090 | A | * | 11/1981 | Chapman | 181/286 |
| 4,522,284 | A | * | 6/1985 | Fearon et al. | 156/290 |
| 4,641,726 | A | * | 2/1987 | Fearon et al. | 156/290 |
| 5,817,992 | A | * | 10/1998 | D'Antonio | 181/295 |
| 6,021,612 | A | * | 2/2000 | Dunn et al. | 181/286 |
| 6,260,660 | B1 | * | 7/2001 | Yoerkie et al. | 181/286 |

* cited by examiner

*Primary Examiner*—Robert E. Nappi
(74) *Attorney, Agent, or Firm*—H. Jay Spiegel

(57) ABSTRACT

A motorized and computer controlled TRIFFUSOR® acoustical treatment system includes a plurality of TRIFFUSOR® banks mounted in various locations within a listening room. Mechanical actuators such as gears and sprockets are employed to mechanically couple the individual units of each bank together. In the preferred embodiment, an electrical motor is coupled into the gearing so that rotation of the electrical motor results in indexing of the different faces of each TRIFFUSOR® unit to the three possible positions (absorptive, reflective or diffusive) facing the interior of the listening room. A programmable logic-controlled motor control unit is provided and programmed to coordinate activation of different TRIFFUSOR® banks throughout the listening space. In the preferred embodiment, a touch screen is provided which allows the operator to touch various locations on the screen that depict artistic renderings of the TRIFFUSOR® banks and in areas of the screen where different instructions are displayed as printed words to enable the operator to adjust the acoustics of the listening room in an efficient, centralized and quick fashion.

20 Claims, 5 Drawing Sheets

MOTORIZED AND COMPUTER OPERATED VARIABLE ACOUSTICS TREATMENT

BACKGROUND OF THE INVENTION

Sound may be modified or controlled in three ways: It can be re-directed by a reflecting surface, attenuated by an absorptive surface, or uniformly scattered by a diffusive surface. The sound that we hear in a room is a combination of direct sound and sound reflected from the boundaries of the room. If a space is to be used for more than one type of acoustical performance, a need arises to be able to adjust the acoustical environment to optimally satisfy the needs of each type of use.

As buildings are built with rooms designed for multiple purposes, the ability to adjust the acoustics of such a room becomes crucial. There are many ways to adjust the acoustics of a room. For example, retractable curtains are often employed to change the absorptive characteristics of a wall. Adjustable low frequency Helmholtz and membrane absorbers have been employed to modify the low frequency behavior of rooms. Interchangeable panels have also been employed to vary acoustics between absorption, reflection and diffusion.

RPG DIFFUSOR SYSTEMS, INC. (RPG) of Upper Marlboro, Md. has sold a product for over 13 years under the federally registered Trademark TRIFFUSOR®. The TRIFFUSOR® device consists of triangular cross-section acoustical treatments wherein each face thereof may be selectively indexed to a position facing within a room so that the acoustical characteristics of the particular facing surface are employed. RPG, the Assignee of the present application, typically employs a different acoustical treatment on each of the three surfaces of the TRIFFUSOR® device, most commonly a reflective surface on one face, an absorptive surface on another face, and a diffusive surface on the third face.

The TRIFFUSOR® device is sold by RPG in sets of triangular cross-section units that may be manually manipulated to cause the desired acoustical treatment to be operational. However, in large rooms and auditoriums, where acoustical treatments may be located in areas that are inaccessible to manual operation, a need has developed for an acoustical treatment system that may be remotely actuated. It is with this need in mind that the present invention was developed.

SUMMARY OF THE INVENTION

The present invention relates to a motorized and computer operated acoustical treatment. The present invention includes the following interrelated objects, aspects and features:

(1) In a first aspect, the present invention involves motorizing and computer controlling a TRIFFUSOR® acoustical treatment system. The TRIFFUSOR® system involves one or a multiplicity of triangular cross-section acoustical devices elongated in a direction perpendicular to their triangular cross-section and pivoted about a rotation axis parallel with their direction of elongation. One or a multiplicity of such units, of any desired number, may be mounted in a suitable frame side-by-side so as to comprise a generally rectangular wall surface. Each unit may be individually controlled, or some or all of the units in a particular frame may be controlled together. For example, in one frame containing 12 units, each unit may be controlled individually, all 12 units may be controlled together, groups of three or four units may be controlled as individual groups, or any other combination or permutation thereof.

(2) Where one desires to control all of the units in unison, each unit is coupled to the other units in a set or bank so that they are all constrained to rotate together to index their respective acoustical surfaces in unison with one another. Thus, the units in a set or bank may be rotated so that the wall surface created thereby is wholly absorptive, wholly reflective, or wholly diffusive.

(3) A plurality of such TRIFFUSOR® sets or banks are mounted in various locations within a listening room. Mechanical means such as gears and sprockets may be employed to mechanically couple the individual units of each set or bank together. In the preferred embodiment, an electrical motor is coupled into the gearing so that rotation of the electrical motor results in indexing of the different faces of each TRIFFUSOR® unit to the three possible positions facing the interior of the listening room.

(4) A programmable logic-controlled motor control unit is provided and programmed to coordinate activation of different TRIFFUSOR® sets or banks throughout the listening space. Use of the remote motor control units is particularly attractive where the listening space is an auditorium or arena where the TRIFFUSOR® sets or banks may be located in diverse locations that are inaccessible even with a tall ladder. In the preferred embodiment, a touch screen is provided which allows the operator to touch various locations on the screen that depict artistic renderings of the TRIFFUSOR® sets or banks and in areas of the screen where different instructions are displayed as printed words to enable the operator to adjust the acoustics of the listening room in an efficient, centralized and quick fashion.

Accordingly, it is a first object of the present invention to provide a motorized and computer operated variable acoustics treatment.

It is a further object of the present invention to provide such a treatment wherein a plurality of TRIFFUSOR® sets or banks are dispersed throughout a listening room and controlled remotely.

It is a still further object of the present invention to provide such a treatment wherein each individual TRIFFUSOR® unit, set, bank or group thereof is indexed to different acoustical treatments through the use of a motor and transmission.

It is a still further object of the present invention to provide such a treatment wherein a computer is programmed to facilitate adjustments of the indexing of each TRIFFUSOR® unit, set, bank or group and a touch screen is employed to permit actuation.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 6:
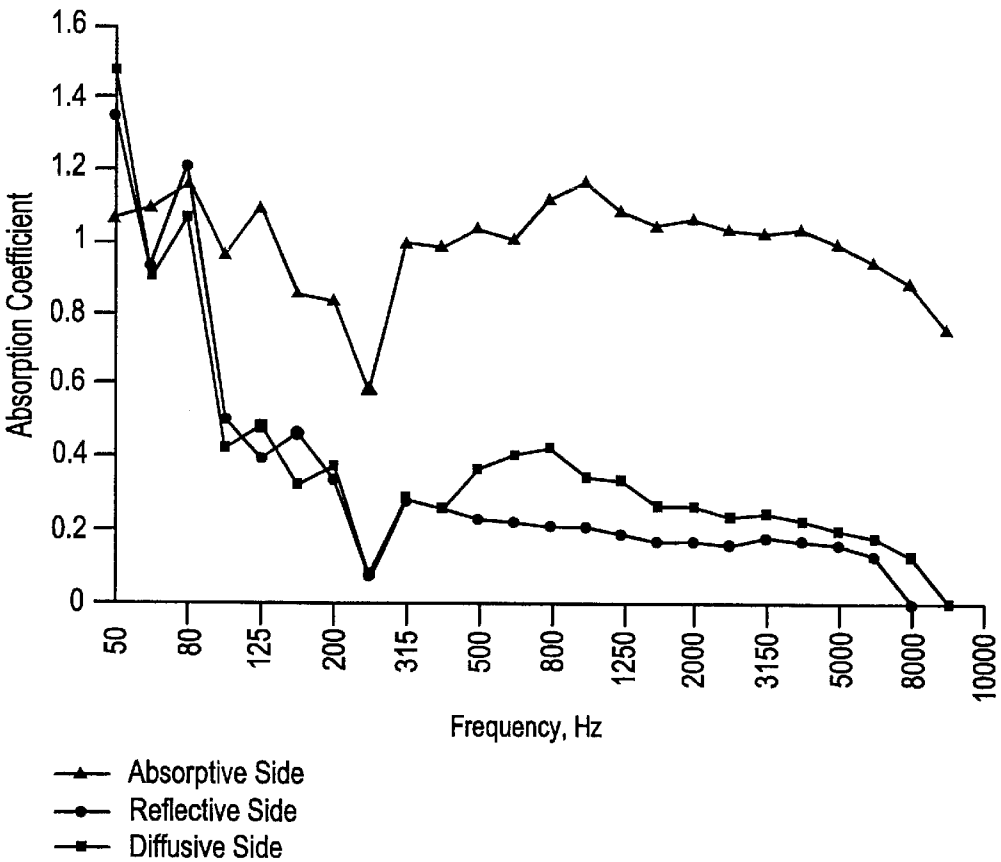
FIG. 6 shows a graph of absorption coefficient versus frequency for the absorptive side, reflective side, and diffusive side of each TRIFFUSOR® bank and unit.
Figure 7:
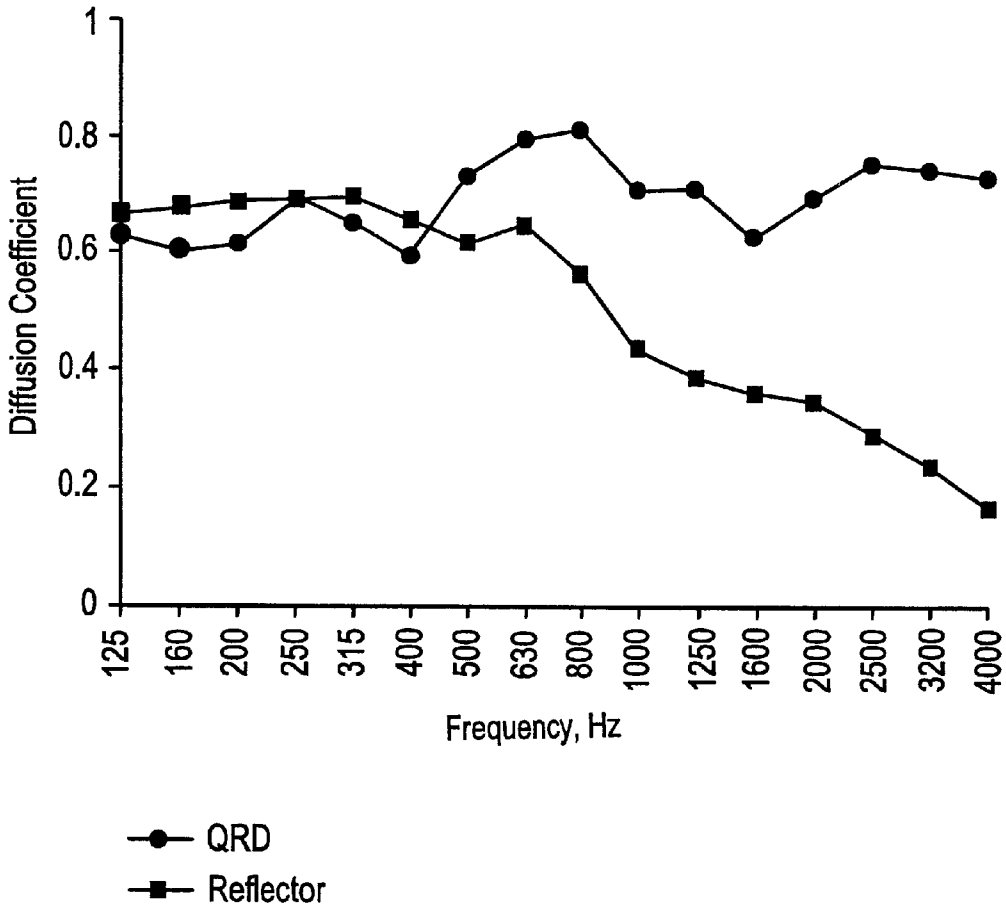
FIG. 7 shows a diffusion coefficient graph for a QRD® diffuser and a reflective surface.

With reference, first, to FIG. 6, in order for a variable acoustics system to be effective, each orientation of each unit must offer acoustical performance that is distinct from the acoustical performances of the other two faces of the unit. In order to determine whether this is the case for the TRIFFUSOR® systems used in accordance with the teachings of the present invention, a six unit TRIFFUSOR® bank covering 72 square feet was tested. FIG. 6 shows the performance with differing frequencies for each of the absorptive, reflective, and diffusive faces of the system. As seen in FIG. 6, there is a dramatic difference between the acoustical performance of the absorptive, reflective, and diffusive sides. The built-in low frequency absorption below 250 Hz is quite evident. The pressure-gradient quadratic-residue absorption peak of 800 Hz also differentiates the diffusive face from the reflective face. Below 565 Hz, the reflective and diffusive faces offer similar performances since within this frequency range, the wavelengths are so large that they do not "see" the surface topology of the diffuser. However, above 565 Hz, which is the frequency at which the width of the panel is half a wavelength, the diffuser shows its ability to uniformly scatter sound. This is shown in the diffusion coefficient graph of FIG. 7. It is seen from FIG. 7 that the Reflector (square marked) falls with frequency indicating that it is approaching complete specularity (zero on the Diffusion Coefficient axis). On the other hand, the QRD® diffuser maintains a relatively constant diffusion from 125 Hz to 4000 Hz.

Figure 1:
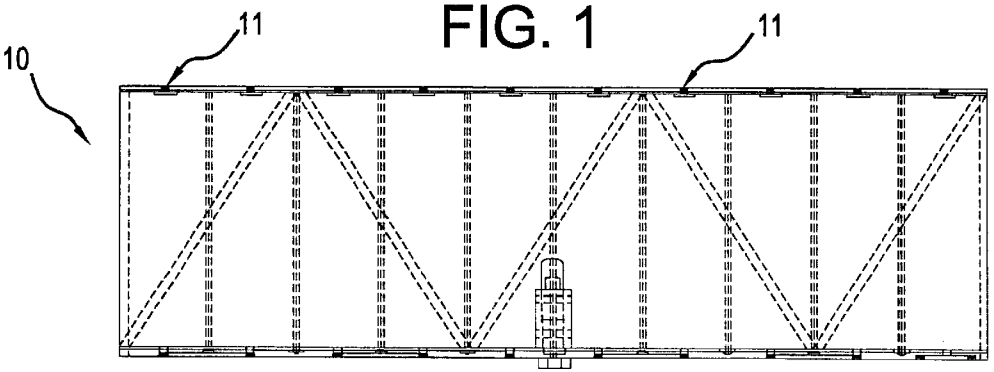
FIG. 1 shows a front view of a TRIFFUSOR® bank including, in the example shown, ten individual TRIFFUSOR® units.
Figure 2:
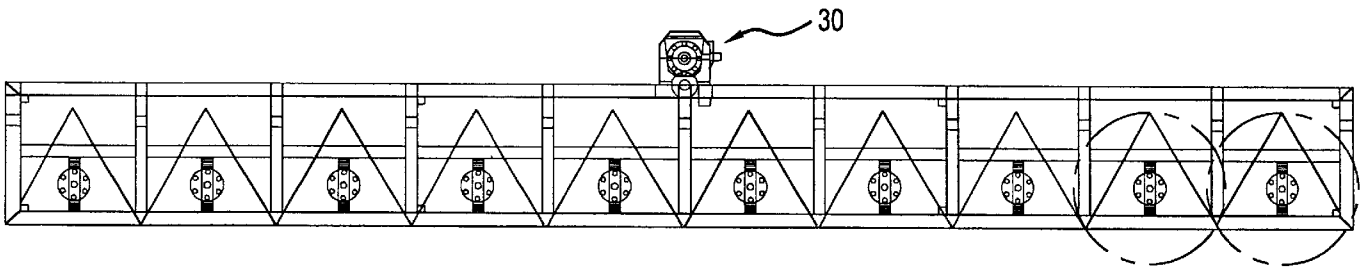
FIG. 2 shows a top view of the TRIFFUSOR® bank of FIG. 1.
Figure 3:
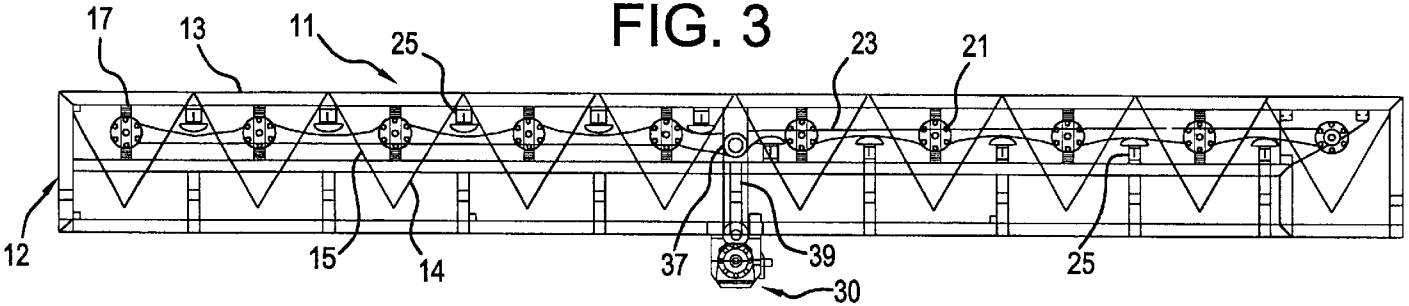
FIG. 3 shows a bottom view of the TRIFFUSOR® bank of FIG. 1.

With reference, now, to FIGS. 1–4, specific details of a TRIFFUSOR® bank or system will be described. With reference to these figures, the bank is generally designated by the reference numeral 10 and is seen to include a multiplicity of individual units 11. In FIGS. 1–3, ten such units are shown, although this number is merely exemplary. Any desired number of units may suitably be employed.

The units 11 are mounted in a frame 12 (FIG. 4) and, with reference to FIGS. 2 and 3, each unit 11 has an equilateral triangular cross-section including three faces 13, 14 and 15.

Each unit 11 is rotatably mounted in the frame 12 by pivots 17 and 19 that extend along the long axis of elongation of each unit 11.

Figure 4:
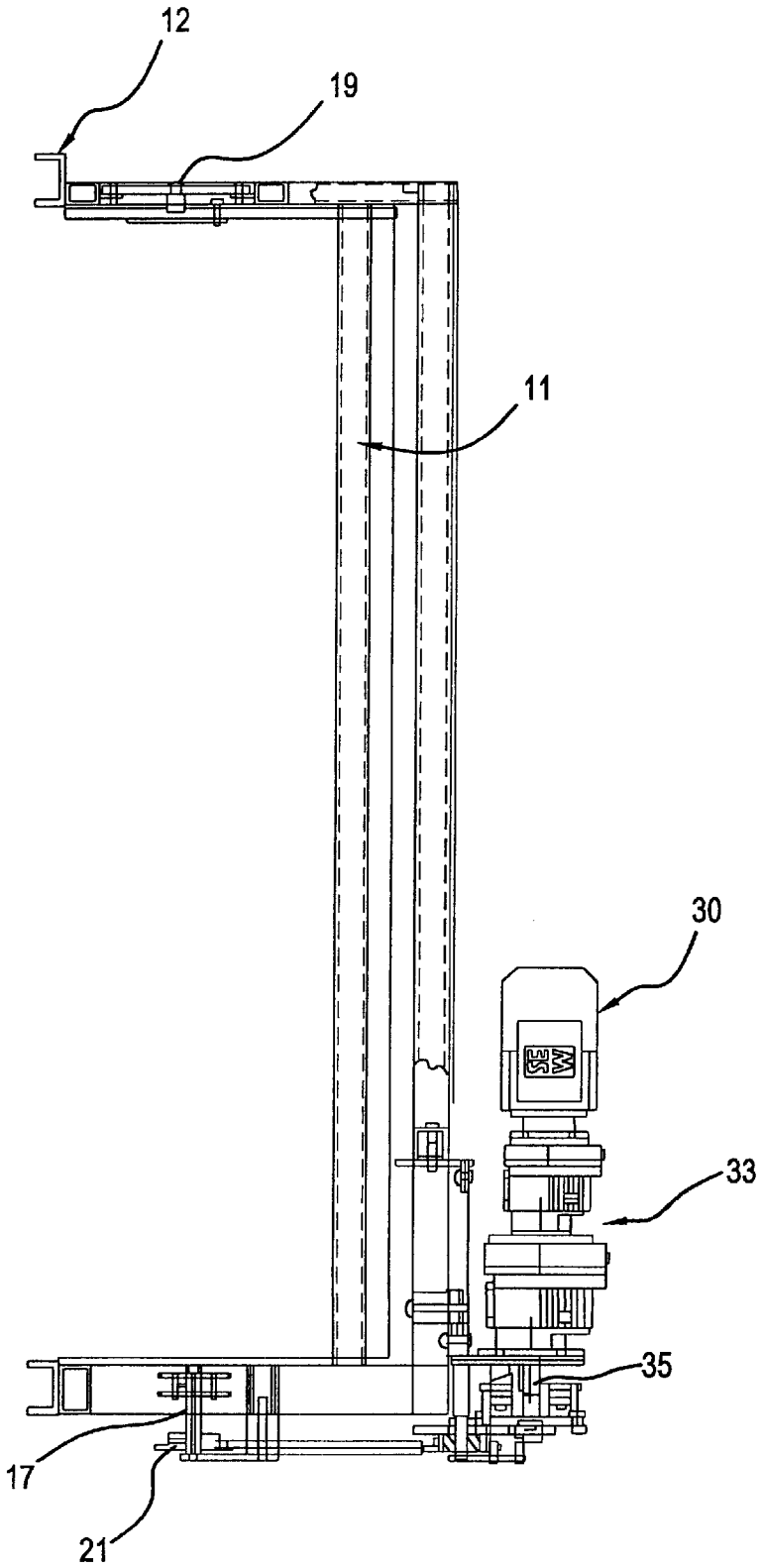
FIG. 4 shows a side view of the TRIFFUSOR® bank of FIGS. 1–3.

With further reference to FIGS. 3 and 4, it is seen that the pivots comprise a shaft 17 extending downwardly from the bottom of a unit 11 and a short pivot 19 extending upwardly from a top of the unit 11. The shaft 17 and pivot 19 are mounted within the frame 12 so as to permit smooth rotation of the unit 11.

With particular reference to FIG. 4, drive means includes a gear or sprocket 21 fixedly mounted on each shaft 17. The drive means further includes an elongated chain 23 extending the length of the system 10 and engaging each gear or sprocket 21 on both sides thereof. Spring biased tensioners 25 are mounted in the frame 12 and serve to tension the chain 23 so that it continuously engages all of the gears or sprockets 21 so that all of the units 11 are constrained to move together so that their respective faces may all align in a direction facing into a room and giving the perception of a flat wall surface.

Actuator means comprising a drive motor 30 (best seen in FIG. 4) is mounted on the frame 12 and is coupled to a transmission 33 to best form the relatively rapid rotations of the drive shaft of the motor 30 to relatively slow rotations of a transmission output shaft 35. The transmission output shaft 35 is suitably coupled to a gear or sprocket 37 by means such as a chain 39, such that rotations of the output shaft of the motor 30 result in rotations of the gear 37 and therefore driving of the chain 23 and rotation of each TRIFFUSOR® unit 11. The motor 30 is controlled in a manner to be described in greater detail hereinbelow.

Figure 5:
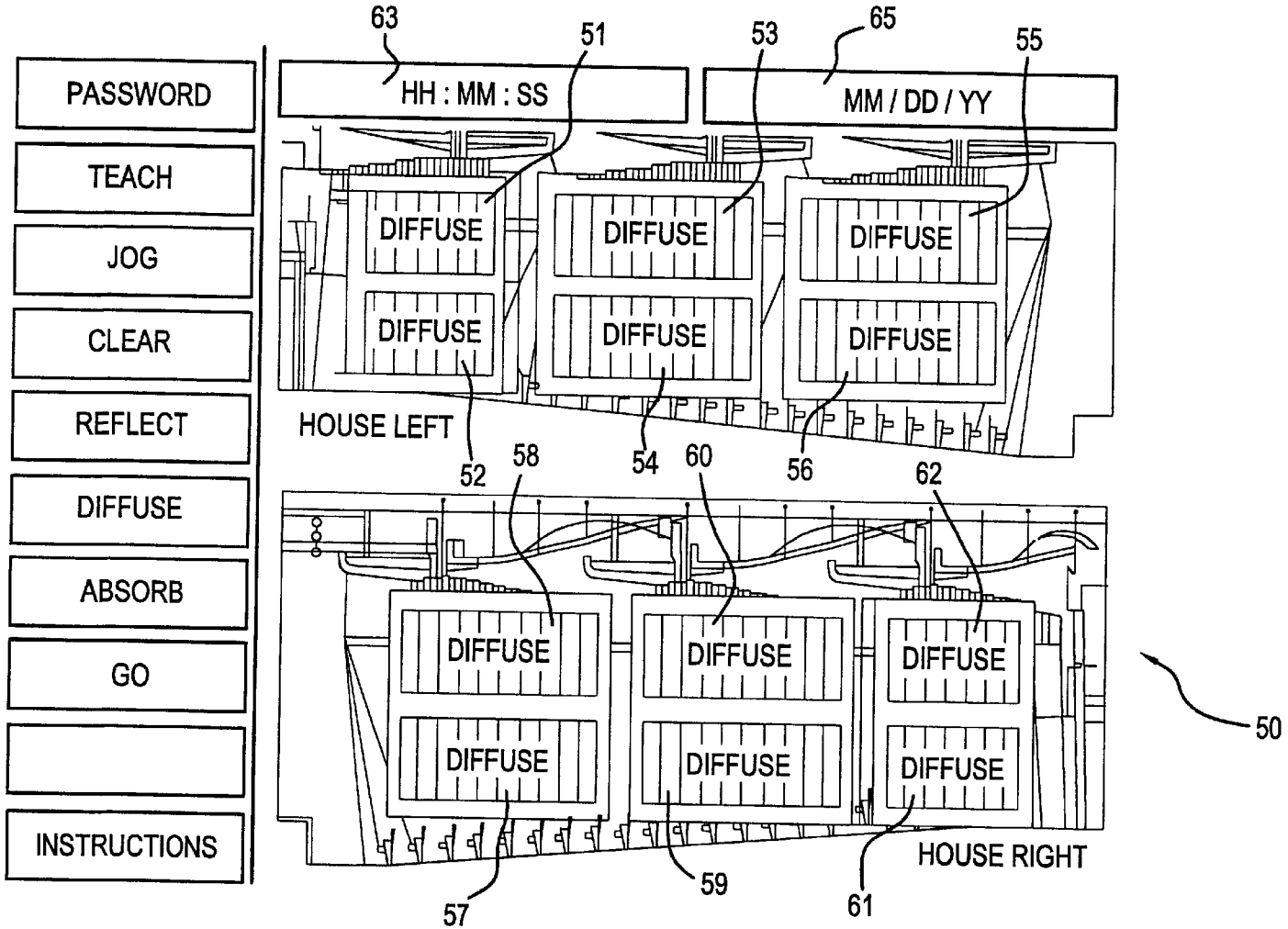
FIG. 5 shows a front view of a display of a computer touch screen used to activate the TRIFFUSOR® banks.

FIG. 5 shows a touch screen 50 that forms a part of a display (not shown) electrically incorporated into control means comprising a programmable logic-controlled motor control unit (not shown) which is programmed to facilitate interaction between actuations of the touch screen 50 and actuations of a TRIFFUSOR® bank such as the bank 10 illustrated in FIGS. 1–4. FIG. 5 shows the type of display that would be employed for twelve banks of TRIFFUSOR® units arranged on the left and right side of an auditorium with each bank being mounted with another bank in pairs of banks. In the depiction shown in FIG. 5, each of the individual banks of TRIFFUSOR® units in each pair of banks may be operated individually. The banks are designated by the reference numerals 51, 52, 53, 54, 55, 56, 57, 58, 59, 60, 61 and 62. As is visible in the display 50, each bank includes a unique number of units which depends upon the particular size and characteristics of the auditorium where the installation will take place. Thus, some of the banks include six units, some include seven units, while others include ten units. This is merely exemplary. Each pair of banks includes two banks 11 as should be self-evident. The display also includes an indication 63 for the time and an indication 65 for the date. Printed words are provided on the left-hand side of the display 50 that allow inputting of commands to adjust the banks 51–62 either as a pair or individually. These words include "PASSWORD", "TEACH", "JOG", "CLEAR", "REFLECT", "DIFFUSE", "ABSORB", "GO" and "INSTRUCTIONS".

In the preferred embodiment, the computer includes a pre-configured programmable logic control system used to provide desired variable acoustic conditions. The software provides a "TEACH" mode in which the variable acoustics units can be configured as desired. When the system is being set up, initially, with the touch screen 50 (FIG. 5) being displayed as shown, one preferred mode of initial set up would include the following instructions:

(1) Press the "PASSWORD" area on the touch screen and enter the pre-selected "PASSWORD";

(2) Touch on the screen 50 over an area where one of the pairs of banks of TRIFFUSOR® units is depicted. A colored border will appear surrounding the bank chosen;

(3) Press the "JOG" button which causes the motor 30 of the pre-selected bank to activate to index all of the units in the bank to the next rotative position one-third of a revolution away from the previous orientation;

(4) Press the "JOG" button sequentially until the TRIFFUSOR® panels that are visible are, for example, those that comprise reflectors;

(5) When the "REFLECT" panels are facing the interior of the room, press the "TEACH" area on the display 50 which tells the computer that that position is the "REFLECT" position;

(6) Press the "CLEAR" button to clear the selection and repeat for all of the different banks of TRIFFUSOR® units 51–62 until all of them are showing the "REFLECT" panels;

(7) When this procedure is completed for all of the TRIFFUSOR® banks, the "PASSWORD" region on the screen is touched;

(8) The user's "PASSWORD" is entered again;

(9) The "TEACH" phase is now complete and the system is ready for use.

With the system preprogrammed, it will now be desired to set the various TRIFFUSOR® banks to desired orientations, whether reflect, diffuse or absorb. One of the three locations on the display 50 labeled "REFLECT", "DIFFUSE" or "ABSORB" is now touched. That area on the display 50 will appear to illuminate in a color such as, for example, red. The panels that are to be changed to the chosen orientation are next touched on the display screen and they light up as well. The word "GO" on the screen is touched and the panels index to the chosen TRIFFUSOR® banks index to the desired orientation.

These operating instructions may be repeated for each TRIFFUSOR® bank in the entire system. Thus, some banks will be diffusive, some absorptive, and some reflective, as desired.

If desired, various alarms may be provided in the system. For example, an alarm may be provided if any chain 23 uncouples from one or more of the gears or sprockets 21. Additionally, a temperature sensor (not shown) may be provided for the motor 30 and an over-temperature alarm may be provided. If desired, the display 50 or an associated display may be provided with an indicator that indicates when changes are underway. As should be self-evident from the view of FIG. 5, the status of each TRIFFUSOR® bank will be displayed with lettering such as "DIFFUSE", "REFLECT" and "ABSORB".

TABLE 1

| Trifussor ® Groups | Rear Bottom LRB/ RRB | Rear Top LRT/ RRT | Middle Bottom LMB/ RMB | Middle Top LMT/ RMT | Front Bottom LFB/ RFB | Front Top LFT/ RFT |
|---|---|---|---|---|---|---|
| Applications | | | | | | |
| Speech | | | | | | |
| Choice 1 | A | A | A | A | A | A |
| Choice 2 | A | D | A | D | A | D |
| Music | | | | | | |
| Unamplified, high T60 | R | R | R | R | R | R |
| Unamplified, mid T60 | D | R | D | R | D | R |
| Unamplified, low T60 | D | D | D | D | D | D |
| Amplified, loud | A | A | A | A | A | A |
| Amplified, medium or background music | A | D | A | D | A | D |
| Choice 2 | D | D | D | D | D | D |
| Movies | | | | | | |
| With music/- surround sound | D | D | D | D | D | D |
| With high dialog content | A | D | A | D | A | D |

Table 1 shows an example of groups of TRIFFUSOR® banks that may be arranged in the noted manner in an auditorium. The chart shows the desirable status of each TRIFFUSOR® bank with "A" standing for "ABSORB", with "D" standing for "DIFFUSE", and with "R" standing for "REFLECT". Other abbreviations are as follows:

| | |
|---|---|
| LRB | left rear bottom |
| RRB | right rear bottom |
| LRT | left rear top |
| RRT | right rear top |
| LMB | left middle bottom |
| RMB | right middle bottom |
| LMT | left middle top |
| RMT | right middle top |
| LFB | left front bottom |
| RFB | right front bottom |
| LFT | left front top |
| RFT | right front top |

The applications are shown in the left-hand column and the orientations of each TRIFFUSOR® bank are shown to the right. Preferably, the acoustician will provide the user with a chart such as that which is depicted in Table 1 for each installation so that the user will be better able to adjust and pre-set the TRIFFUSOR® banks for each possible scenario.

As mentioned above, if desired, each unit 11 may be set up to be individually controlled. If this is desired, the chain 23 and tensioners 25 are omitted and each unit 11 is provided with its own motor 30 directly coupled to the shaft 17. The programmable logic-controlled motor control unit is electrically connected to each motor.

As should be understood, programmable logic-controlled motor control units are generally well known and are commonly used for remote actuation of drapes, blinds, windows and other structures.

As such, an invention has been described in terms of the apparatus and its method of use which fulfill each and every one of the objects of the invention as set forth hereinabove, and provide a new and useful motorized and computer operated variable acoustics treatment of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

What is claimed is:

1. A remotely adjustable variable acoustics treatment system, comprising:

a) a plurality of acoustical treatments, each acoustical treatment located in a space separated from other acoustical treatments;

b) each acoustical treatment comprising at least one unit comprising:

i) an elongated body rotatably mounted in a frame;

ii) said body having a triangular cross-section with three faces including a sound absorptive face, a sound reflective face, and a sound diffusive face;

iii) each unit being adapted to rotate about an axis of elongation thereof;

c) each acoustical treatment including actuator means for rotating units thereof about their axes of elongation; and d) control means for controlling said actuator means.

2. The system of claim 1, wherein said triangular cross-section comprises an equilateral triangular cross-section.

3. The system of claim 1, wherein said actuator means comprises a motor.

4. The system of claim 3, wherein said motor comprises an electric motor.

5. The system of claim 1, wherein said control means comprises a programmable logic-controlled motor control unit.

6. The system of claim 5, wherein said motor control unit includes a display screen.

7. The system of claim 6, wherein said display screen depicts a visualization of acoustical treatments in said system including positional status thereof.

8. The system of claim 7, wherein said display screen comprises a touch screen wherein a user may touch various regions thereon to effect actuation of said system.

9. The system of claim 1, wherein at least one of said acoustical treatments includes a plurality of units.

10. The system of claim 9, wherein each unit of said plurality of units has a separate motor whereby each unit is separately rotatable.

11. The system of claim 9, wherein said actuator means rotates all of the units in said plurality of units in unison.

12. The system of claim 11, wherein said actuator means for said at least one of said acoustical treatments comprises:

a) a single motor; and b) drive means coupling said single motor to all of the units thereof.

13. The system of claim 12, wherein said drive means comprises a first gear attached to a drive shaft of said single motor, a separate gear attached to each unit and a chain coupled to all of said gears, whereby rotation of said first gear results in concurrent rotation of said separate gears and, thereby, said units.

14. The system of claim 10, wherein all of said acoustical treatments include a plurality of units.

15. A remotely adjustable variable acoustics treatment system, comprising:

a) a plurality of acoustical treatments, each acoustical treatment located in a space separated from other acoustical treatments;

b) each acoustical treatment comprising a plurality of units, each unit comprising:

i) an elongated body rotatably mounted in a frame;

ii) said body having an equilateral triangular cross-section with three faces including a sound absorptive face, a sound reflective face, and a sound diffusive face;

iii) each unit being adapted to rotate about an axis of elongation thereof;

c) each acoustical treatment including actuator means for rotating units thereof in unison about their axes of elongation; and d) control means for controlling said actuator means and comprising a programmable logic-controlled motor control unit having a display screen.

16. The system of claim 15, wherein said actuator means comprises an electric motor.

17. The system of claim 15, wherein said display screen depicts a visualization of acoustical treatments in said system including positional status thereof and comprises a touch screen wherein a user may touch various regions thereon to effect actuation of said system.

18. The system of claim 15, wherein said actuator means for said at least one of said acoustical treatments comprises:

a) a single motor; and b) drive means coupling said single motor to all of the units thereof.

19. The system of claim 18, wherein said drive means comprises a first gear attached to a drive shaft of said single motor, a separate gear attached to each unit and a chain coupled to all of said gears, whereby rotation of said first gear results in concurrent rotation of said separate gears and, thereby, said units.

20. The system of claim 19, wherein all of said acoustical treatments include a plurality of units.

* * * * *